United States Patent [19]

Gross et al.

[11] Patent Number: 4,462,808

[45] Date of Patent: Jul. 31, 1984

[54] DISPERSANT FOR HIGH SOLIDS COAL-WATER SLURRIES

[75] Inventors: Anthony E. Gross, Clarendon Hills; Merle L. Branning, Warrenville; Dodd W. Fong, Naperville, all of Ill.

[73] Assignee: Nalco Chemical Company, Oak Brook, Ill.

[21] Appl. No.: 520,351

[22] Filed: Aug. 4, 1983

[51] Int. Cl.[3] ..... C10L 1/32

[52] U.S. Cl. ..... 44/51; 44/71; 252/354; 260/513 N; 406/47; 406/49; 526/287

[58] Field of Search ..... 44/51, 71; 406/47, 49, 406/197; 252/308, 309, 344, 332, 338, 351, 355, 354; 260/513 N; 526/287

[56] References Cited

U.S. PATENT DOCUMENTS 4,282,006 8/1981 Funk ..... 44/51

*Primary Examiner*—Charles F. Warren
*Assistant Examiner*—Margaret B. Medley
*Attorney, Agent, or Firm*—John G. Premo; Robert A. Miller; Donald G. Epple

[57] ABSTRACT

An improved coal-water slurry containing finely divided coal particles and a dispersing agent which is comprised of a water-soluble homopolymer of a monomer represented by the formula:

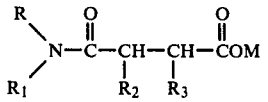

wherein:

M is hydrogen, lithium, sodium, potassium, magnesium, or calcium;

R is allyl or methallyl;

$R_1$ is hydrogen, allyl or methallyl;

$R_2$ is hydrogen or sulfonate;

$R_3$ is hydrogen or sulfonate; and providing that $R_2$ is not the same as $R_3$.

These improved coal-water slurries are best formulated at a pH of at least 6 and, preferably, above 8. The dispersants have a molecular weight between 1000–20,000.

6 Claims, No Drawings

DISPERSANT FOR HIGH SOLIDS COAL-WATER SLURRIES

INTRODUCTION

U.S. Pat. No. 4,282,006 discloses pipeline pumped high-solids content coal-water slurries. These slurries may be generically characterized as having a Brookfield viscosity of about 2000 cps or less at 60 rpm at about 75 weight percent, dry basis, coal content. These slurries, because of their high coal content, are capable of being directly burned in a furnace. Prior art coal-water slurries having a lower coal content must first be subjected to a dewatering step prior to being utilized as a fuel. The slurries described in U.S. Pat. No. 4,282,006 are fluid and pumpable because of several factors. The primary factor contributing to high solid content and fluidity is the particle size distribution of these slurries. The other factor is the type and amount of dispersing agent and/or electrolyte used in the preparation of these slurries.

The particle size distribution of the coal slurries set forth in U.S. Pat. No. 4,282,006 corresponds to a formula set forth in the patent. This formula is known as the Alfred formula. When plotted in the form of a graph, the particle size distribution is basically a straight line. One of the discoveries of the present invention is that slurries other than, as well as, those described in U.S. Pat. No. 4,282,006 may be prepared as pumpable high solid coal concentrates. These concentrates, when their particle size distribution is plotted as a graph, do not appear to fall within the non-undulating particle distributions taught in the U.S. Pat. No. 4,282,006.

The goal of this invention is to obtain high concentrated coal-water slurries which are pumpable and which, when stored for a reasonable length of time, can easily be redispersed and pumpable without substantial settling losses.

The present invention contemplates utilizing an improved surfactant to prepare concentrated coal-water slurries. These slurries may be of the type described in U.S. Pat. No. 4,282,006 as well as other similar slurries which contain a different particle size distribution from that described in U.S. Pat. No. 4,282,006.

Though detailed analysis of particle size is not present, aqueous coal slurries using various dispersing agents are also taught in U.S. Pat. Nos. 4,242,098 and 4,302,212.

THE INVENTION

The invention comprises an improved coal-water slurry of the type comprising at least 45% by weight of finely divided coal particles and a dispersing agent, said slurry being characterized as having a Brookfield viscosity at 60 rpm of less than 3000 centipoise, the improvement comprising adjusting the pH of said slurry to at least 6 and using as the dispersing agent a water-soluble homopolymer of a monomer represented by the formula:

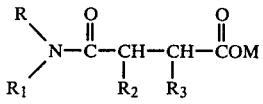

wherein:

M is hydrogen, lithium, sodium, potassium, magnesium, or calcium;

R is allyl or methallyl;

$R_1$ is hydrogen, allyl or methallyl;

$R_2$ is hydrogen or sulfonate;

$R_3$ is hydrogen or sulfonate; and providing that $R_2$ is not the same as $R_3$.

The homopolymers above are found to be most effective when their molecular weights are between about 1000–20,000.

Preferably, the invention is an improved coal water slurry of the type comprising at least 45% by weight of finely divided coal particles and a dispersing agent, said slurry being characterized as having a Brookfield viscosity at 60 rpm of less than 3000 centipoise, the improvement which comprises adjusting the pH of said slurry to at least 6 and using as the dispersing agent a water-soluble homopolymer of 3-carboxy-3-sulfo-N,N-diallylpropionamide having a molecular weight within the range of about 1000–20,000. Molecular weights in this patent are the peak maximum molecular weights as determined by gel-phase chromatography. This invention is particularly adapted to providing improved Alfred formula coal-water slurries.

The Water-Soluble Homopolymers

The homopolymers found useful in this invention are made by homopolymerizing monomers of the type represented by the following chemical formula:

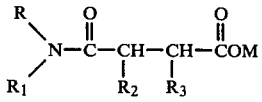

wherein: M is chosen from the group consisting of hydrogen, lithium, sodium, potassium, ammonium, magnesium, and calcium; R and $R_1$ are chosen from the group consisting of hydrogen, allyl, and methallyl, providing that when R is hydrogen, $R_1$ is either allyl or methallyl; and wherein $R_2$ and $R_3$ are chosen from the group consisting of hydrogen or sulfonato substitution, providing that $R_2$ and $R_3$ can never be the same.

Homopolymers are made preferably from anionic monomers of the following formula:

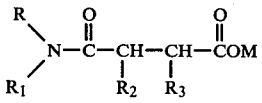

wherein: R is the allyl group, $R_1$ is hydrogen, $R_2$ is hydrogen, $R_3$ is the sulfonato group, and M is chosen from the group consisting of hydrogen, lithium, sodium, ammonium, potassium, magnesium, and calcium.

Another preferred anionic monomer which can be used for the homopolymers of this invention would be represented by the chemical formula:

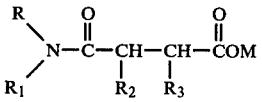

wherein: R and $R_1$ are both allyl groups, $R_2$ is hydrogen, and $R_3$ is the sulfonato group, with M being chosen from the group consisting of hydrogen, lithium, sodium, potassium, ammonium, magnesium, and calcium.

Similarly anionic monomers represented by the chemical formula:

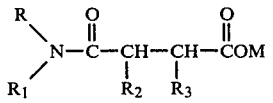

wherein: R is the allyl group, $R_1$ is hydrogen, $R_2$ is the sulfonato group, $R_3$ is hydrogen, and M is from the group consisting of hydrogen, lithium, sodium, potassium, ammonium, magnesium, and calcium may be used to form the homopolymers useful in this invention.

Similarly, the anionic monomers described by the above formula may also exist wherein R and $R_1$ are both allyl groups, $R_2$ is the sulfonato group, $R_3$ is hydrogen and M is again represented by the group hydrogen, lithium, sodium, ammonium, potassium, magnesium, and calcium, and homopolymers therefrom are useful to achieve the coal-water slurries herein.

The preferred anionic monomers which are capable of homopolymerization are represented by the formula:

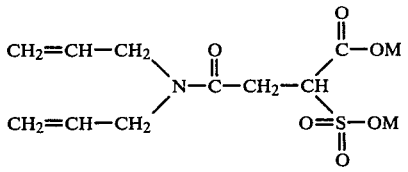

wherein: M is chosen from the group consisting of hydrogen, lithium, sodium, potassium, and ammonium.

Similarly, another preferred anionic monomer which is capable of homopolymerization is represented by the formula:

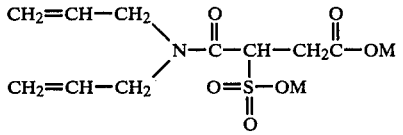

wherein: M is chosen from the group consisting of hydrogen, lithium, sodium, potassium, and ammonium.

Likewise, another preferred anionic monomer which is capable of homopolymerization is represented by the formula:

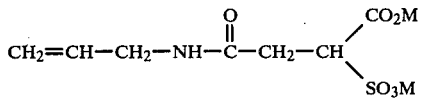

wherein: M is chosen from the group consisting of hydrogen, lithium, sodium, ammonium, and potassium.

Homopolymers of this Invention

The homopolymers of this invention may be formed from free radical initiation of the monomers outlined above dissolved in any convenient solvent. For example, a homopolymer was formed by adding a free radical initiator, Vazo-50 (2,2'-Azobis (2-amidinopropane) Hydrochloride), to an aqueous solution of the 3-carboxy-3-sulfo-N,N-diallylpropionamide (VI) in a sealed vial under a nitrogen atmosphere. The polymerization solution had a pH of 6.6, the vial was sealed under nitrogen, and the vial was kept in an oven at 50°-60° C. for seven (7) days. The solution contents were monitored by Carbon-13 NMR which indicated the total disappearance of the allyl groups during the polymerization. Gel permeation chromatography showed that the average molecular weight of this homopolymer was about 16,400 with a dispersity factor of 2.2 (compared against polystyrene sulfonate as the standard).

The following homopolymers have also been made:

1. Poly(3-carboxy-3-sulfo-N,N-diallylpropionamide) 3-Carboxy-3-sulfo-N,N-diallylpropionamide (VI) (10 g), water (7 g) and V-50 (0.5 g) were charged into a 40 mL vial and sealed under nitrogen. The pH of the solution was 6.6 and the vial was sealed under nitrogen. The vial was kept in an oven at 50°-60° C. for seven (7) days. Carbon NMR of the solution showed the disappearance of the allyl groups. GPC showed the molecular weight average (Mw) of the polymers was 16,400 with a dispersity factor of 2.2 using polystyrene sulfonate as the standard.
2. VI (7.7 g), water (87 g) and V-50 (1 g) were charged into a 250 mL resin kettle. The pH of the solution was adjusted to 8.4, and the sample was heated to 50°-55° C. under nitrogen for 24 hours. Then 1 more gram of V-50 was added and heated to 70°-80° C. for 24 hours. GPC showed the molecular weight average of the polymers was 7010 with as dispersity factor of 1.6.
3. Poly(3-Carboxy-3-sulfo-N-allylpropionamide) 3-Carboxy-3-sulfo-N-allylpropionamide (20 g), water (30 g), and V-50 (0.4 g) were charged into a 100 mL vial under nitrogen and kept in a 60° C. oven for seven (7) days. Carbon NMR analysis of the polymer solution showed the disappearance of the allyl groups. GPC showed the molecular weight average of the polymer was below 1000.

The homopolymers useful in this invention are homopolymers that have a molecular weight between about 1000-20,000. The preferred molecular weight range is between about 5000-17,500. The polymers having the prescribed preferred molecular weight are used in a water-soluble form such as their salt form. For example, the alkali metal ammonia or amine salt form. The sodium salt form is preferred.

pH of the Slurry

The dispersants used in the practice of the invention provide low viscosity slurries when the pH of the slurry has been adjusted to at least 6 and, preferably, the pH is adjusted to 7 or more, most preferably above about 8.0. Usually pH adjustment need not exceed 9.5 to obtain the advantages of the invention.

Dosage of the Dispersing Agent

The amount of dispersing agent used in the practice of the invention will range up to about 5% by weight based on the total weight of dry coal. Preferably the dosage will be within the range of 0.01 to 5% by weight of coal. A preferred dosage is 0.5 to 2% by weight of coal.

Particle Size Distribution

As indicated previously, the invention may utilize as a coal-water slurry a slurry which has coal particles distributed in accordance with the formula set forth in U.S. Pat. No. 4,282,006.

This formula is as follows:

$$CPFT = \left\{ \frac{D_\mu{}^n - D_S{}^n}{D_L{}^n - D_S{}^n} \right\} \cdot 100, \text{ where}$$

CPFT=cumulative weight percent, dry basis, of particles finer than a particle $\mu$ of stated size, $D_\mu$=diameter of particle $\mu$, $D_L$=diameter of largest particle in compact, sieve size or its equivalent, $D_S$=diameter of smallest particle in compact, SEM size or its equivalent, n=numerical exponent, with n being in the range of 0.2 to 1.0, and with all diameters sized in $\mu$m, The particle size distribution of the coal particles according to the above formula for CPFT provides a non-undulating size distribution of particles which permits closer packing of more particles of coal in a specific volume of space in the compact than can be achieved with a particle size distribution which has undulating distribution of particles. Also, sizes of $D_L$ and $D_S$ have important effects on the suitability of the particle size distribution for use in the coal-water slurry. When $D_L$ is too large, large particles can settle out and cause pumping problems. When $D_S$ is too large and less than about 5 weight percent, dry basis, of particles of colloidal size that are present in the coal compact, the stability of the yield stress and the rheological properties of the coal-water slurry are adversely affected and the slurry may segregate or become dilatent or otherwise not pumpable. The value of the numerical exponent n in the formula CPFT is affected by the values of $D_L$ and $D_S$. While n will usually range from 0.2 to 1.0, n preferably will be in the range from about 0.2 to 0.7. $D_L$ usually will be in the range from 1180 $\mu$m to 38 $\mu$m and will preferably be in the range of 70 $\mu$m (micrometer or micron) to 600 $\mu$m, and most preferably will be about 300 $\mu$m. $D_S$ will be less than 3 $\mu$m (3 $\mu$m) and usually will be in the range of 0.05 $\mu$m to 0.3 $\mu$m, and preferably will be about 0.1 $\mu$m.

The above formula is the Alfred formula.

While the Alfred formula represents one type of particle size distribution of finely divided coal that may be used to prepare the slurries of the invention, it will be understood others may be used without departing from the scope hereof.

It will be understood that the present invention has applicability to producing coal slurries from grinds having particle size distributions somewhat similar to the Alfred coal-water slurries although particle size distribution may vary from the limits set forth in U.S. Pat. No. 4,282,006.

EXAMPLES

Coal slurry testing was conducted on a coal slurry paste which consisted of 66% solids, inherent moisture of 12.9%, and a particle size distribution of 76% less than 75 micrometers—21% less than 9.4 micrometers. Tests consisted of adding various types of viscosity-reducing agents to the coal slurry at 0.5 weight percent based on the coal solids. Measurement of the final viscosity of the resulting slurry indicates success or failure of the additive component. Table I presents data derived from the addition of various homopolymers of the most preferred monomer listed above, 3-carboxy-3-sulfo-N,N-diallylproprionamide (hereinafter referred to as CASDAPA).

TABLE I

| Dispersant | Brookfield Viscosity (cps) | Polymer Mol. Wt. |
|---|---|---|
| Blank | 3000 | Blank |
| CASDAPA | 2400 | 1,000 |
| " | 400 | 6,000 |
| " | 310 | 12,650 |
| " | 275 | 16,100 |
| Lomar D | 325 | — |

In Table I the blank is an untreated coal slurry having the characteristics outlined above. Lomar D is an industry standard which can be seen to be less effective than the polymers of this invention.

To complete the studies using the homopolymers of this invention, slurries were prepared and ground in a ball mill grinder at a 70% coal solids level until the grinding mechanism produced proper particle sizes, that is, about 80% less than 75 microns to 25% less than 9.4 microns. The CASDAPA homopolymers were added to the coal at a concentration level of 0.4 weight percent based on coal solids prior to grinding. The grinding time ranged from about 120–130 minutes with the final pH of the grind being about 9.0±0.2. The grinding was done in the presence of from 0.5–2.0 grams of concentrated ammonium hydroxide to raise the pH above 6.0 and, preferably, above 8.0. The final viscosity of the coal grind even at this high 70% solids loading was 275 centipoise as measured with a #2 spindle at 30 rpm. The conclusion reached was that excellent viscosity reduction is observed with the CASDAPA homopolymers even when particle size distributions much finer than normally observed are achieved. The particle size distribution between 3 and 300 $\mu$m is outlined in Table II.

TABLE II

| Particle Size Distribution (% × $\mu$m) | |
|---|---|
| Particle Size ($\mu$m) | % Less Than Stated Particle Size |
| 300 | 100% |
| 212 | 100% |
| 150 | 100% |
| 106 | 92.7% |
| 75 | 88.8% |
| 53 | 83.8% |
| 38 | 71.1% |
| 27 | 58.2% |
| 19 | 47.4% |
| 13 | 40.4% |
| 9.4 | 32.5% |
| 6.6 | 22.7% |
| 4.7 | 12.3% |

The preparation of the coal slurries and the incorporation therein of the CASDAPA homopolymers of this invention may be accomplished by any of the techniques described in U.S. Pat. No. 4,282,006. Such grinding and milling techniques are well known and need not be described in detail herein. U.S. Pat. No. 4,282,006 is incorporated herein by reference.

Having thus described our invention, it is claimed as follows:

1. An improved coal-water slurry of the type comprising at least 45% by weight of finely divided coal particles and a dispersing agent, said slurry being characterized as having a Brookfield viscosity at 60 rpm of less than 3000 centipoise, the improvement comprising adjusting the ph of said slurry to at least 6 and using as the dispersing agent a water-soluble homopolymer of a monomer represented by the formula:

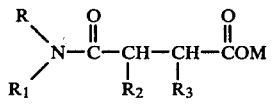

wherein:

M is hydrogen, lithium, sodium, potassium, magnesium, or calcium;

R is allyl or methallyl;

$R_1$ is hydrogen, allyl or methallyl;

$R_2$ is hydrogen or sulfonate;

$R_3$ is hydrogen or sulfonate; and providing that $R_2$ is not the same as $R_3$.

2. The improved coal slurry of claim 1 wherein the improvement comprises using as the dispersing agent the water-soluble homopolymer of claim 1 having a molecular weight ranging between about 1000–20,000.

3. An improved coal-water slurry of the type comprising at least 45% by weight of finely divided coal particles and a dispersing agent, said slurry being characterized as having a Brookfield viscosity at 60 rpm of less than 3000 centipoise, the improvement comprising adjusting the pH of said slurry to at least 6 and using as the dispersing agent a water-soluble homopolymer of 3-carboxy-3-sulfo-N,N-diallylpropionamide having a molecular weight between about 1000–20,000.

4. The improved coal slurry of claim 3 wherein the homopolymer of 3-carboxy-3-sulfo-N,N-diallylpropionamide has a molecular weight between about 2500–17,500 and is present in the slurry at a dosage of from 0.01–5.0 weight percent based on coal.

5. The improved coal slurry of claim 3 wherein the pH of the slurry is at least 8 and the dispersing agent is a homopolymer of CASDAPA having a molecular weight between about 5000–17,500 which is present in the slurry at a dosage of from 0.1 to about 2.0 weight percent based on coal.

6. The improved coal slurry of claim 3 wherein the pH of the slurry is at least 8 and the dispersing agent is a homopolymer of CASDAPA having a molecular weight between about 12,000–17,000 which is present in the slurry at a dosage of from 0.4 to 0.5 weight percent based on coal.

* * * * *